US005081735A

United States Patent [19]

Wyatt et al.

[11] Patent Number: 5,081,735

[45] Date of Patent: Jan. 21, 1992

[54] GOLF IRON CLEANER

[76] Inventors: William B. Wyatt, 9545 Inavale Dr.; Herbert M. Burnette, 8208 Wikle Rd. East, both of Brentwood, Tenn. 37027; Joseph G. Callahan, 5929 Abbott Dr., Nashville, Tenn. 37211; Blake A. Mevis, 811 18th Ave., South, Nashville, Tenn. 37203

[21] Appl. No.: 525,735

[22] Filed: May 18, 1990

[51] Int. Cl.[5] ..... B08B 1/00

[52] U.S. Cl. ..... 15/104.92; 15/21.2; 15/88.1; 15/104.94

[58] Field of Search ..... 15/104.92, 104.94, 88.1, 15/88.3, 21.2, 21.1

[56] References Cited

U.S. PATENT DOCUMENTS

| | | | |
|---|---|---|---|
| 2,744,276 | 5/1956 | Chambless | 15/104.92 |
| 3,400,416 | 9/1968 | Nicholson et al. | 15/21.2 |
| 3,748,676 | 7/1973 | Warren et al. | 15/21.2 |
| 4,734,952 | 4/1988 | Parchment et al. | 15/104.92 |
| 4,821,358 | 4/1989 | Wyckhoff et al. | 15/88.1 X |
| 4,944,063 | 7/1990 | Jordan | 15/104.92 |
| 4,958,396 | 9/1990 | Butler et al. | 15/88.4 X |
| 4,965,906 | 10/1990 | Mauro | 15/104.92 |

*Primary Examiner*—Chris K. Moore

[57] ABSTRACT

A golf iron cleaner particularly adapted to clean all golf irons, regardless of the loft, equally well. The present invention provides a golf iron cleaner that includes a container in which brushes are removably mounted. There are two brushes in each container and the bristles of each brush project inwardly toward each other. While the brushes face each other, the bristles do not touch, thus creating a channel between the bristles of the two brushes. The bristles of the two brushes are of a length so that the channel gives an appearance of a smooth curve, and as one progresses along the curve of the channel, the curve tends to mirror the loft of a golf iron as the loft is increased through the range of irons in a set. The bristles of one of the brushes are of a greater diameter and are thus stiffer than the bristles of the other brush. The container is positioned within a housing and can be removed from the housing to dispose of waste materials and to remove the brushes and cleanse them.

16 Claims, 2 Drawing Sheets

GOLF IRON CLEANER

BACKGROUND OF THE INVENTION

Golf is a well known recreational activity of ancient and honorable origins. Over the years, as the skills of the players of golf, both amateur and professional, have improved, much effort has been directed toward improving the equipment available to the players.

The game of golf is one in which the player advances the golf ball over a course by striking the ball with one of as many as fourteen clubs in a set. Each iron in a set of clubs generally has a shaft with a grip on one end and a iron head on the other. The player holds the iron at the grip area and swings the iron causing an impact of the iron head with the ball, advancing the ball over the course, from tee to green until the ball is "holed out" on each hole.

Of the fourteen clubs that a player is allowed to carry in a set, generally ten to eleven clubs are called "irons", that is to say that the iron head which is attached to the shaft of the iron is an iron or other cast metal structure. Of the ten or eleven irons in a set, they are generally numbered one through nine plus a pitching wedge and sand wedge. As the iron numbers progress from one upward, the loft of the face of the iron generally increases. Thus, the face of the iron head (the face being the portion of the iron which is used to strike the golf ball) of a one iron will be practically parallel to the axis of the shaft of the iron. As one progresses through the numbered irons in a set of irons, the angle of the face of the iron, in relationship to the axis of the shaft, increases. Because of the different loft on each golf iron, depending upon the iron, as the loft increases, the shot will be at a higher trajectory and will therefore travel a shorter distance. Players, through hours of practice, are able to judge the distance that they can hit a ball using each individual iron and therefore are able to control the distance of their shot. However, even though the player can control the distance of his shot, unless he can control the distance the ball rolls after it lands, he may nevertheless have an unsatisfactory result from a well executed shot.

Generally the irons of a set of clubs are used when shots are made approaching the green; thus, it is the players objective to land the ball as close to the hole as possible and to stop the ball at that location. After a golf ball is struck, when it lands, it will tend to roll forward, particularly if it has topspin or overspin, and the distance of the roll can be a product of many factors. The distance of the roll may be affected by the amount of overspin; it may be affected by the level of the terrain, whether the ball lands into an uphill grade or a downhill grade; the particular iron used to make the shot; and the like. If the ball has backspin after it is struck, when it lands, it will tend to stop where it lands, or possibly even spin back a few feet. Because of the varying distance of roll in the event that the ball does have overspin, the player can not control the placement of the shot in the same manner as he can when the ball has backspin.

The face of almost all the modern golf irons contains a series of parallel grooves, the grooves themselves being generally perpendicular to the axis of the shaft of the iron. The purpose of these grooves is to give the golfer greater control over his golf shot. When the iron is swung and the face strikes the golf ball, the grooves in the face will cause the golf ball to have backspin as it is propelled through the air toward the target. When the golf ball lands, the backspin on the golf ball will cause it to tend to stop at the spot where it lands or close thereby. In fact, often times, a well struck ball will have sufficient backspin to cause the ball to land, bounce forward and then spin or roll back a short distance toward the direction of the golfer who hit the shot.

The grooves in the face of the golf iron are a significant factor in the spin that is applied to the ball when it is struck by the player and thus the need for the present invention. If the grooves in the face of the golf iron get clogged, then the face of the golf iron is essentially flat and the grooves do not impart a spin to the golf ball in the same fashion as would happen if the grooves in the iron are clean and clear of debris. Each time that a golf ball is struck with the iron, the player normally takes a "divot", i.e., a portion of the turf on which the ball sits. In those cases, earth, sand, grass, and other debris will get lodged in the grooves of the iron face and impair the effectiveness of the equipment. Players over the years have used a golf tee to clean the grooves in their iron; they have used towels to wipe the iron face; they have on occasion carried knives or other sharp instruments that would clean the grooves in the iron face; and some players have gone so far as to carry with them a small wire or bristle brush that they use to clean their iron face after a shot. These solutions to this problem are awkward, cumbersome and ineffective, and the present invention is designed to remedy the problem of maintaining a clean golf iron face, especially the grooves therein, in a convenient and efficient manner, with a device that is portable, inexpensive, and effective.

PRIOR ART

The problem to which this invention is directed has been addressed in a number of prior art patents. Deficiencies of these prior art patents are, however, quite apparent when compared to the present invention. For example, in the patent to L. L. Smith, U.S. Pat. No. 3,148,396, discloses a golf iron head cleaner which employs electric motors arranged to rotate brushes that are aligned in fixed proximity to each other. The brushes are not curved and therefore do not have an alignment which cleans the irons with varying lofts in the manner of the present invention. In addition, the Smith device is cumbersome, not portable, and requires electrical power to operate. Similar deficiencies are evident to the patent to Hartz et al, U.S. Pat. No. 4,069,536. In the Hartz invention, cylindrically shaped brushes are aligned in opposing fashion and a golf iron is cleaned by agitating the iron between the two brushes. As is the case with the Smith patent, the structure of the Hartz invention does not incorporate curved brushes and therefore fails to adequately clean the irons having varying degrees of loft. Finally, the patent to Caradonna, U.S. Pat. No. 4,380,839, discloses a golf iron cleaner designed to be mounted on a post or similar arrangement in a fashion similar to the golf ball cleaners that find extensive use as peripheral equipment to the game of golf. The invention of Caradonna is similar to the present invention in that it has brushes that face each other and a cleaning solution contained within a chamber in which the brushes are mounted so that the golf iron can be inserted between the brushes and agitated to clean the iron. The invention of Caradonna is deficient however in a number of areas.

Specifically, it fails to have brushes that are curved or configured in a fashion that will clean irons of varying lofts. In addition, the open top of the Caradonna cleaning device would tend to allow the cleaning fluid to slosh out of the container and create a nuisance for the user of the device. Finally, there is no provision in the Caradonna device to conveniently remove the soapy cleaning fluid and dispose of it in a place remote from the location of the cleaning device. Draining the device as suggested by Caradonna would be unsightly and inconvenient. Thus, when the Caradonna device is cleaned, soapy water is drained onto the golf course which would tend to destroy vegetation that may surround the location of the cleaning device.

SUMMARY OF THE INVENTION

Considering the deficiencies of the devices as represented by the prior art, it is apparent from the disclosure contained herein that the device of the present invention overcomes these deficiencies by providing a golf iron cleaning device which has a set of brushes that are designed, configured, and oriented such that they maximize the scrubbing capacity for each iron in a set of irons regardless of the degree of loft of the particular iron. This result is achieved by a device which contains two brushes mounted within a container, the brushes being oriented such that the bristles of the brushes face each other. The ends of the bristles do not touch, thus creating a channel between the brushes. The bristles of the brushes are cut or otherwise configured of a length so that the channel formed between the bristles of the brushes has a smooth curved shape.

One of the brushes has bristles that are thicker or otherwise made of material to make them stiffer than the bristles of the opposing brush. The bristles of the opposing brush are thinner or are of a material such that they are more flexible and the more flexible bristles are used to scrub the face of the iron. The firmer bristles clean the back of the iron but also function as a guide to guide the iron through the channel so that as the iron is agitated up and down in the container, the bristles will clean the entire iron. The high numbered irons will get a better cleaning action toward the bottom of the container because of the curvature of the channel between the bristles which conforms to the shape of the face of the iron at that point. Similarly, lower numbered irons will get better cleaning action toward the top of the device and middle irons will clean better in the middle of the device because the shape of the brush created by the varying lengths of bristles will mirror the iron face and allow the free ends of the bristles to get into the grooves.

The container itself is positioned within a housing and is removably lodged therein. The housing has a top which can be shut over the container to prevent the cleaning fluid from sloshing out of the cleaning device. The top is pivotally mounted to the housing so that it can be opened and allow the container to be removed. A lid is structured within the top and can be opened to allow the golf iron itself to be inserted within the cleaning device and when the lid is shut, there is a guide formed within the lid that surrounds the shaft of the golf iron so that the golf iron will be properly aligned for use of the cleaning device. The shaft is allowed to freely move up and down through the guide when the shaft is agitated up and down to clean the iron. While this action is taking place, the lid is closed, once again preventing any of the cleaning fluid from sloshing out onto the user of the device.

Finally, the housing has integrally formed in the bottom thereof slots for holding the head of a bolt and the bolts extend through the housing so that the cleaning device can be connected to a golf cart, a stationery post, a bench, or the like to take advantage of its features.

Having briefly described and summarize the features and advantages of the invention, a detailed description of the preferred embodiment of the invention follows which when taken in conjunction with the drawings in which like numerals are referred to like features, will give a clear understanding of the advantages and benefits of this invention.

DESCRIPTION OF THE DRAWINGS

Made a part of this application are the drawings in which.

DESCRIPTION OF THE PREFERRED EMBODIMENT OF THE INVENTION

The following description is of the preferred embodiment of the invention, which, when taken in conjunction with the drawings wherein the like characters refer to like parts, from all of which, the advantages of this invention will become apparent to those skilled in the art.

Figure 1:
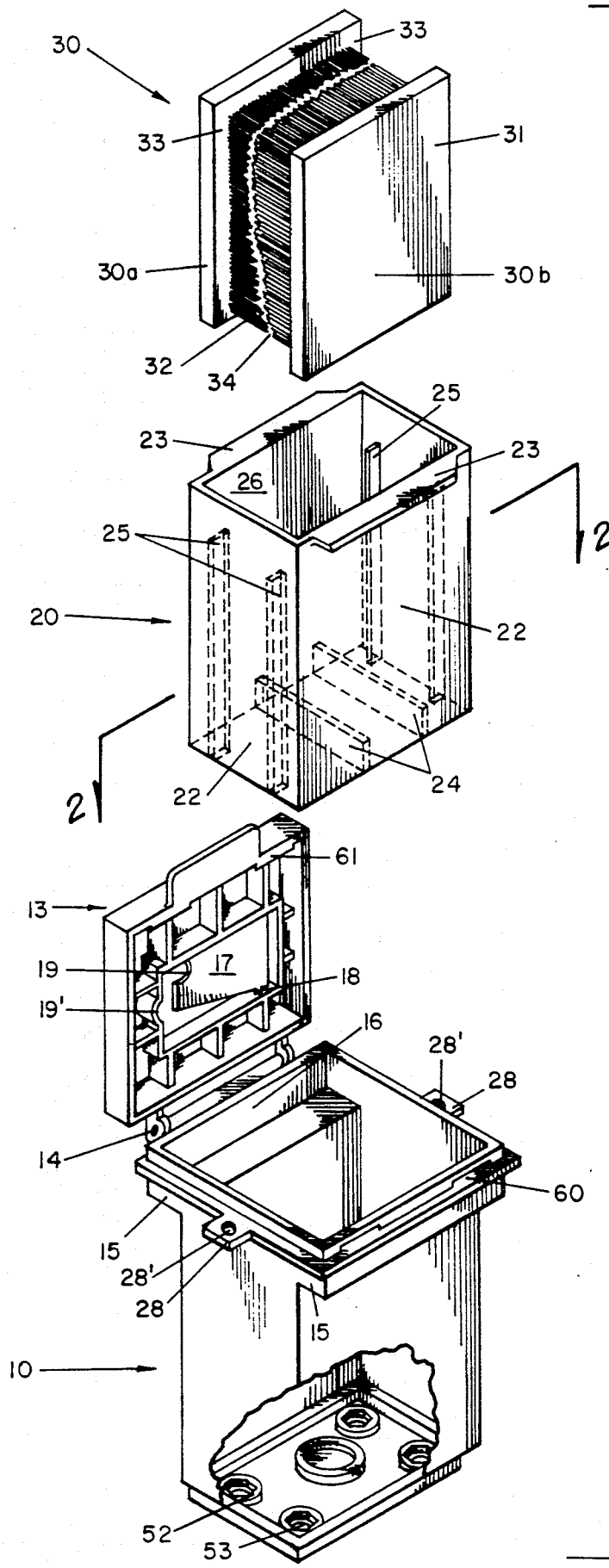
FIG. 1 shows a prospective view of the preferred embodiment of the invention with the housing and container telescopically aligned.

Referring to FIG. 1, the invention is shown in a prospective view with the various parts of the invention arranged in a telescopic relationship.

The preferred embodiment of this invention has three basic parts: a housing 10, a container 20 and brushes 30. The brushes 30 fit within the container 20 which in turn is positioned within the housing 10. The housing 10 has a bottom 11 and side walls 12. The top 13 of the housing 10 is pivotally connected to one of the side walls 12 via hinge 14. The top 13 rotates about the pivotal connection of hinge 14 so that it can be raised to the opened position as shown in FIG. 1 or lowered to close the housing 10 as shown in FIG. 4*a*.

Integrally formed in the top portion of the housing 10 on opposing side walls 12 are shoulders 15 which creates an offset 16. When the container 20 is positioned within the housing 10, the offset 16 create a space between the container 20 and the housing 10 which facilitates maintenance of the cleaning device. By the offset 16 there is provided a place for the fingers of one who desires to remove the container 20 from the housing 10 to grip the container 20 and lift it from the housing 10; thus allowing one to dispose of the dirty cleaning fluid within the container 20.

The container 20 has a bottom 21, opposing sidewalls 22, connecting sidewalls 22' and lips 23. Baffles 24 extend vertically upwardly within the container protruding inside the container 20 from the bottom 21. Guides 25 protrude in from the opposing sidewalls 22 into the chamber 26 of the container 20. The guides 25 extend generally perpendicular to the baffles 24.

Figure 2:
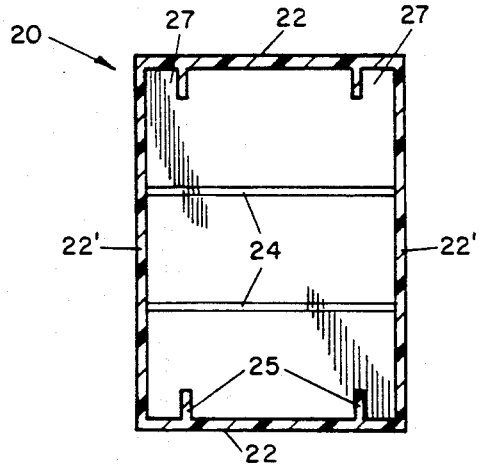
FIG. 2 shows a cross section taken along the line of 2—2 of FIG. 1.

As can be best seen from FIG. 2, the guides 25 are spaced from connecting sidewalls 22' so as to create a channel 27 between the connecting sidewalls 22' and the guide 25.

Brushes 30 are constructed of brush blocks 31 and bristles 32. The bristles 32 do not cover the entire surface of the brush block 31, leaving opposite edges 33 to serve as brush guides for the positioning of the brushes within the chamber 26 of the container 20.

Figure 2A:
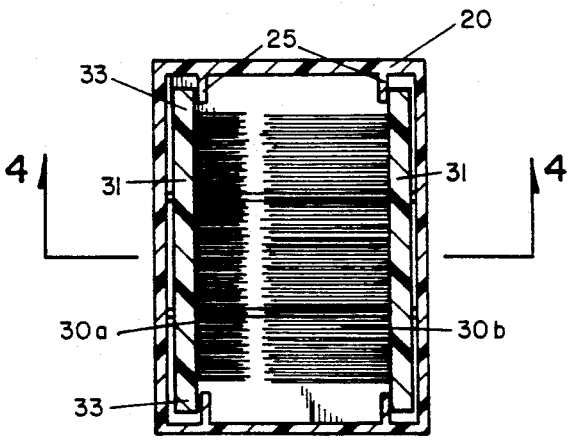
FIG. 2*a* is a cross section taken along the line of 2—2 with the brushes inserted in the container.
Figure 2B:
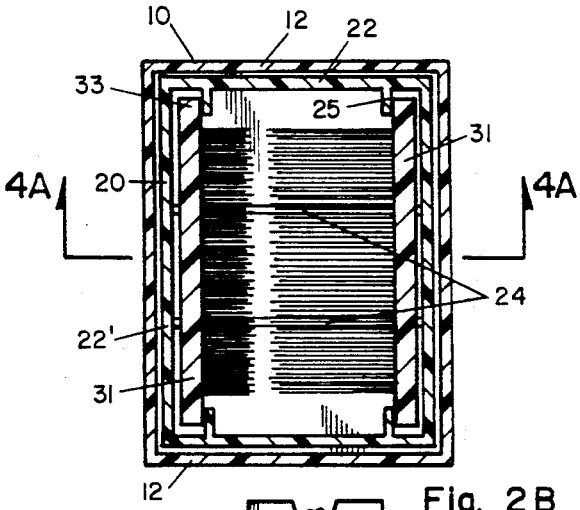
FIG. 2*b* is a cross section of the invention in an assembled relationship taken midway of the invention looking toward the bottom of the cleaning device.

As can be seen from FIG. 1, as well as FIG. 2*a* and FIG. 2*b*, the edges 33 fit within the channels 27 and align the brushes 30 so that the bristles 32 of each brush are directed inwardly toward the center of the chamber 26 of the container 20 with the free ends 34 of the bristles 32 being directed toward each other but spaced apart to form a channel 35 between the free ends 34 of the bristles.

Figure 4:
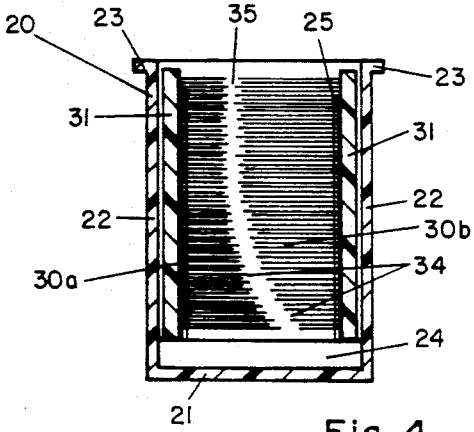
FIG. 4 is a cross section taken along the line of 4—4 of FIG. 2*a;*
Figure 4A:
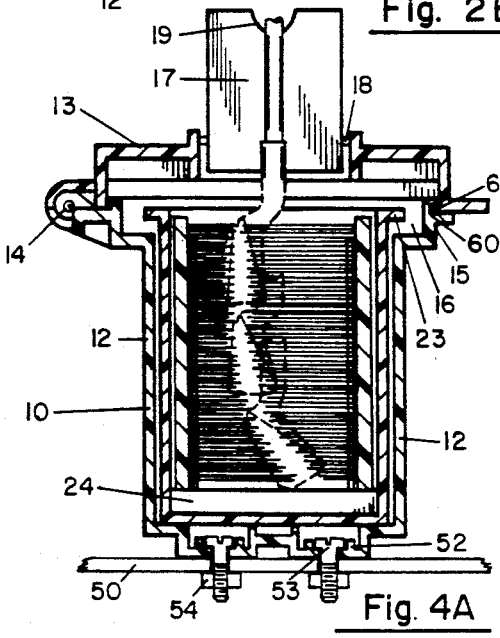
FIG. 4*a* is a cross section taken along the line of 4*a*—4*a* of FIG. 2*b*.

As can be seen in FIG. 4 and FIG. 4*a*, the channel 35 has a gradual curve as one progresses along the channel 35 from the top of the container 20 to the bottom of the container 20. The gradual curve of the channel 35 will generally conform to the loft of the face of a golf iron as one progress through the irons in a set from a one iron through a nine iron and on to a pitching wedge and sand wedge. Thus, the bristles 32 of the brush that scrubs the face of the iron are of such a length that they tend to conform generally to the profile of the face of the iron, and the experience of the inventors is that this gives a superior cleaning action to the face of the iron. In the preferred embodiment, the bristles of the two brushes are of different strengths therefore one set of bristles is more flexible than the other. The firmer set of bristles will act as a guide for the backside of the gold iron and the softer or more flexible bristles will act as the primary scrubbing bristles for the face of the golf iron. Of course, the bristles at the back of the iron will also clean the back of the iron head, but the primary objective is to clean the grooves in the face of the iron and the face of the iron itself. The softer bristles are more adaptable to that function.

Figure 3:
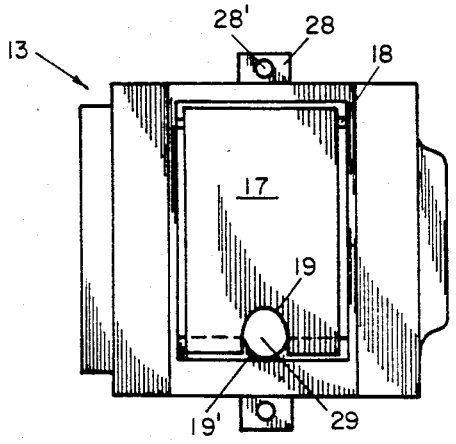
FIG. 3 is a top view of the invention.

As can be seen from FIG. 3, the top 13 has a pivotal hinge 18 connecting the lid 17 to the top 13. The lid 17 can thus be rotated about the pivotal hinge 18 to the open position as shown in FIG. 4*a* and in FIG. 1 or rotated to the closed position as is shown in FIG. 3. In the edge of the lid opposite from the pivotal hinge 18, there is intricately formed a semicircular cut-out 19 which mirrors the semicircular cut-out 19' in the top 13 thus forming a circular opening 29 in the top 13 when the lid is in the closed position. Of course, the entire circular opening 29 could be intricately formed in either the edge of the lid 17 or the top 13 so long as it provided access for the shaft of golf iron after the iron is inserted into the cleaning device and the lid 17 is closed. The circular opening 29 would normally be spaced midway between the shoulders 15 of the housing but clearly, the location of the circular opening 29 could be adjusted in one direction or the other. However, the spatial relationship between the opening 29 and the channel 35 is significant so that if the location of the circular opening 29 is moved, the brushes would have to be constructed in such fashion that the location of the channel 35 would also be adjusted.

Integrally formed with the housing 10 are tabs 28 on sidewalls 12. These tabs are preferably formed on the sidewalls 12 that connect the sidewalls 12 bearing the shoulders 15, but the location of the tabs 28 could otherwise be structured. The tabs 28 have holes which facilitate the connection of a cleaning towel to be attached to the present invention to wipe one's golf irons once they have been cleaned through the use of the present invention.

As can be seen from FIG. 4 and FIG. 4*a*, the channel 35 between the brushes 30 starts at the top of the cleaning device off-centered between the sidewalls 12 which bear shoulders 15. In this particular configuration, at the top of the channel 35, the channel 35 is moved from the center of the container toward the sidewall which bears the hinge 14. As can be seen from FIG, 4*a*, because golf irons have an offset at the hosel, when the shaft of the iron is placed in the circular opening 29, it is necessary to have the channel 35 not be in alignment with the circular opening 29 in order to accommodate the off-set structure of most golf irons. The need for this off-set alignment can be seen from the phantom line presentation of various golf irons within the cleaning structure as illustrated in FIG. 4*a*. The curve of the channel 35 will gradually move away from the wall bearing the hinge 14 until the channel 35 at the bottom of the container is closer to the sidewall 12 facing the wall bearing hinge 14 than it is to the wall bearing hinge 14 itself.

Referring again to FIG. 1, as can be seen by the manner in which the brushes 30 are inserted into container 20, the brushes may be removed and rotated 180 degrees so that the channel 35 will then be directed toward the hinged wall of the housing 10 as opposed to being curved away from the hinged wall. By reversing the location of the brushes, the invention facilitates the cleaning of a left-handed set of irons as well as a right handed set of irons. This same function can be accomplished by simply rotating the container 180 degrees within the housing.

The inventors have determined that the preferred structure and arrangement of the brushes is as set forth below. To facilitate the description of the preferred embodiment of the invention, the two brushes will be designated as brushes 30*a* and 30*b*. Brush 30*a* will be referred to as a backing brush and brush 30*b* will be referred to as a facing brush:

The backing brush 30*a* has relatively short bristles at the top of the brush which gradually increase in length as one progresses longitudinally of the device toward the bottom of the brush. The polypropylene bristles of backing brush 30*a* are preferable 0.017 inches diameter. Facing brush 30*b* has bristles that are relatively long at the top of the brush and gradually decrease in length as one moves towards the bottom of the brush. The bristles of the facing brush 30*b* are preferably polypropylene bristles of approximately 0.014 inches diameter. The inventors have determined that the spacing between the free ends 34 of the bristles should be approximately ⅛ of an inch and the channel 35 near the top of the cleaning device is approximately ½ inch offset from the center of the circular opening 29. The channel 35 is straight for a vertical distance of 2.920 inches down from the top of the brushes. A curve defined by an arc having a radius of 6.4 to 6.526 inches begins at this point and curves through the remaining vertical length of the brushes.

In operation, the cleaning device of the present invention works as follows:

The housing itself is mounted onto a mounting surface 50 via bolts 51 that fit within the bolthead locks 52 and pass through Openings 53 in the bottom of the housing 10. The bolthead locks 52 secure the bolt itself from turning so that when the mounting nut 54 is affixed to the bolt, the bolt can be tightened down under the mounting surface 50 without having to have access to the interior of the cleaning device. The mounting surface 50 could be the back fender of a golf cart, the back of a park bench adjacent to a tee-box, a work bench, or any other stationery structure. Once the housing 10 is mounted onto the mounting surface 50, the container 20 is placed or positioned inside the housing 10 and cleaning fluid is placed in the container to the level that it comes approximately to the top of the bristles 32. After the golfer has hit a shot and has debris on the face of his golf iron, he will lift the lid 17 by rotating it about its pivotal hinge, insert his golf iron into the opening within the top 13 and place the shaft of the golf iron against the cut out 19' in the top 13. The lid 17 is then rotated about its pivotal hinge 18 to close the lid 17 so that the cutout 19 fits against the shaft of the golf iron. The golf iron is now securely guided by the shaft fitting within the circular opening 29. As can be seen from FIG. 4*a*, the offset of the hosel of the golf iron is such that the golf iron now is positioned within the channel 35 between the free ends 34 of the brushes 30. The golf iron is bigger than the channel 35 so that the bristles rest against the rear of the golf iron as well as the face of the golf iron.

The backing brush 30*a* has stiffer bristles than the facing brush 30*b* so that the bristles tend to serve as a guide as well as a cleaning structure for the back of the golf iron. As the golf iron is agitated up and down manually by the user of the device, the back of the golf iron will be guided along the surface formed by the free ends 34 of the bristles of the backing brush 30*a*. At the same time, the softer bristles of the facing brush 30*b* will be cleaning the face of the golf iron as it is agitated up and down in the cleaning device with the softer bristles being able to get in the grooves of the golf iron to more efficiently and completely clean those grooves. The differing golf irons of a set, having different loft on the face of the iron will be equally well cleaned because the bristles of the facing brush 30*b* are curved and tend to mirror the face of the iron being cleaned, depending on the longitudinal position of the particular iron within the device. If the bristles of the facing brush 30*b* did not get shorter as one progresses longitudinally from the top to the bottom of the cleaning device, when a high loft iron was being cleaned, the bristles would tend to bend and fold back upon themselves which would prevent the tips of the bristles from getting into the grooves on the face of the iron to adequately clean those grooves. The present invention, with the shorter bristles on the facing brush 30*b* near the bottom of the container prevents the bristles from bending back upon themselves and thus the tips of the bristles are able to scrub against the face of the iron and get into the grooves of the iron to adequately clean the grooves.

As the golf iron is agitated up and down by the user of the device, the bottom of the iron will hit against the baffles 24 thus preventing the iron from banging against the bottom of the container or against the bottom of the housing 10. This will prevent damage to the device. Also it prevents the iron from being forced into contact with sediment from previous cleaning that would otherwise settle in the bottom of the container. In addition, the baffles 24 prevent the head of the golf iron from protruding below the bottom surface of the bristles then twisting and thus hanging underneath the bristles tending to lift the brushes during the agitating motion required for cleaning. If this were allowed to occur it would be difficult to remove the iron from the device.

When the user of the device is finished cleaning his golf irons, he can raise the lid 17, remove the golf iron, lower the lid to its original position and wipe the iron with a towel that may be hung from the tabs 28.

After a period of use, it will necessary to clean the golf iron cleaning device itself. Such cleaning procedure is readily facilitated by the structure of the present invention. The top 13 is rotatably mounted via hinges 14 where it is connected to sidewall 12. The top 14 has an integrally formed pressure snap connection consisting of seat 60 formed in the outside of the shoulder 15 into which is snapped the dimple 61 which is molded integrally on the underside of top 13. Top 13 also has strengthening walls 62 which are formed into the top to give it added rigidity. These walls 62 also serve another Very important purpose. When top 13 is in the closed position and secured by the pressure snap connection these walls 62 extend over the brush blocks 31 thereby holding down the entire cleaning container 20 including the brushes 30 while the manual up and down agitation motion required to clean the irons is occurring.

When one desires to clean the cleaning device of this invention, the dimple 61 is unsnapped from the seat 60 and the top 13 is rotated about the hinge 14 to the open position. The container 20 may then be lifted from the housing 10 by grabbing the lips 23 and simply lifting the container 20. Vertically. The brushes 30 may be removed from the container 20 and washed with a hose or dipped into a bucket of clean water or other cleaning fluid. The cleaning fluid that is left in the container 20 may then be poured into a bucket or other container to be carried off and disposed of at an area remote from the golf course and the container itself can be hosed out or otherwise cleansed to remove the debris that would have collected from the multiple uses of the device to clean the golf irons of many players. The brushes are now reinserted into the container and held in place by the free ends 33 of the brushes fitting within the channels 27 created by the guides 25 and the connecting side walls 22'. The container 20, in which the brushes are now housed, is lowered back into the housing 10 and filled with fresh cleaning fluid. The top of the container is now rotated back to the closed position with the dimple 61 snapped into the seat 60 to secure the closing of the top.

As will be apparent to one of ordinary skill in the art, the relationship of the various parts of the present invention have significant advantages over similar structures of the prior art. However, these relationships can be varied or altered without changing the intent or essence of the invention provided that the relationships themselves are maintained.

Having described the invention and its preferred embodiment, I claim:

1. A golf iron cleaning device including:

a) a container;

b) a backing brush and a facing brush each consisting of a brush block and bristles;

c) the brushes being removably mounted within the container and facing each other;

d) the bristles of the brushes having opposing ends, one end of each bristle being connected to a brush block and the other end being a free end, projecting from the brush block, and extending toward the center of the container;

e) longitudinally of the cleaning device, the bristles are of varying lengths; and f) the varying lengths of the bristles are such that, moving in one direction longitudinally along the cleaning device, the length of the bristles are gradually increased over at least a portion of at least one of the brushes.

2. The golf iron cleaning device of claim 1 wherein:

g) transversely of the cleaning device, the bristles connected to the brush block of the backing brush are all approximately the same length.

3. The golf iron cleaning device of claim 1 wherein:

g) transversely of the cleaning device, the bristles connected to the brush block of the facing brush are all approximately the same length.

4. The golf iron cleaning device of claim 1 wherein the varying length of the bristles are such that, moving in one direction longitudinally of the cleaning device, the length of the bristles of one brush gradually increase while the length of the bristles of the other brush gradually decrease.

5. The golf iron cleaning device of claims 1 or 4 wherein the varying length of the bristles are such that there is a channel between the free ends of the bristles of the backing brush and the facing brush.

6. The golf iron cleaning device of claim 5 wherein, moving longitudinally of the cleaning device, the channel is curved from one side of the container to the other.

7. The golf iron cleaning device of claims 3 or 4 wherein the varying length of the bristles cause the ends of the bristles to define a curve having a radius of 6.4 to 6.526 inches starting approximately 3.0 inches down from the top of the brushes.

8. A golf iron cleaning device including:

a) a container;

b) a backing brush and a facing brush each consisting of a brush block and bristles;

c) the brushes being removably mounted within the container and facing each other;

d) the bristles of the brushes having opposing ends, one end of each bristle being connected to a brush block and the other end being a free end, projecting from the brush block and extended toward the center of the container; and e) the bristles of the backing brush being of a stiffness greater than the bristles of the facing brush.

9. The golf iron cleaning device of claim 8 wherein, longitudinally of the cleaning device, the bristles are of varying lengths.

10. The golf iron cleaning device of claim 9 wherein the varying lengths of the bristles are such that, moving in one direction longitudinally of the cleaning device, the length of the bristles are gradually increased over at least a portion of at least one of the brushes.

11. The golf iron cleaning device of claim 9 wherein the varying length of the bristles are such that, moving in one direction longitudinally of the cleaning device, the length of the bristles of one brush gradually increase while the length of the bristles of the other brush gradually decrease.

12. The golf iron cleaning device of claims 8 or 11 wherein the varying length of the bristles are such that there is a channel between the free ends of the bristles of the backing brush and the facing brush.

13. A golf iron cleaning device including:

a) a container;

b) a backing brush and a facing brush each consisting of a brush block and bristles;

c) the brushes being removably mounted within the container and facing each other;

d) the bristles of the brushes having opposing ends, one end of each bristle being connected to a brush block and the other end being a free end projection from the brush block, and extended toward the center of the container;

e) a housing in which the container is telescopically positioned; and f) the bottom of the housing has bolthead locking means formed therein and holes therethrough.

14. The golf iron cleaning device of claim 13 wherein the housing includes a top pivotally connected thereto.

15. The golf iron cleaning device of claim 14 wherein the top includes an opening and a lid to close the opening, with the lid being pivotally connected to the remainder of the top.

16. The golf iron cleaning device of claim 15 wherein the opening in the top and the perimeter of the lid each have a notch formed therein to provide an opening through which the shaft of a golf iron will fit.

* * * * *